United States Patent [19]

Loughman

[11] Patent Number: 4,948,036

[45] Date of Patent: Aug. 14, 1990

[54] WRAPPER OR SLEEVE TYPE PACKAGE WITH POCKET AND FLAP LOCK

[75] Inventor: Robert S. Loughman, Horseheads, N.Y.

[73] Assignee: F. M. Howell & Co., Elmira, N.Y.

[21] Appl. No.: 425,404

[22] Filed: Oct. 23, 1989

[51] Int. Cl.[5] ..... B65D 5/46

[52] U.S. Cl. ..... 229/117.14; 206/427; 206/806; 229/40

[58] Field of Search ..... 229/40, 117.13, 117.14; 206/806, 427, 434

[56] References Cited

U.S. PATENT DOCUMENTS

| | | | |
|---|---|---|---|
| 2,074,638 | 3/1937 | Black | 229/117.14 |
| 3,018,919 | 1/1962 | Pelt | 229/117.14 |
| 3,084,843 | 4/1963 | Urban | 229/117.14 |
| 3,157,309 | 11/1964 | Chidsey, Jr.; et al. | 229/40 |
| 4,269,348 | 5/1981 | Young | 229/117.14 |
| 4,399,939 | 8/1983 | Tunick | 229/117.14 |

FOREIGN PATENT DOCUMENTS

| | | | |
|---|---|---|---|
| 396066 | 6/1963 | Switzerland | 229/117.14 |
| 736218 | 9/1955 | United Kingdom | 206/427 |

*Primary Examiner*—Gary E. Elkins

*Attorney, Agent, or Firm*—Mason, Fenwick & Lawrence

[57] ABSTRACT

A wrapper or sleeve type package of paperboard or the like for providing a laterally encompassing wrap package for articles, formed from an elongated blank of paperboard material to provide a bottom panel and a pair of opposite side panels integrally joined thereto to extend upwardly from the bottom panel in laterally encompassing relation to the article to be contained therein. At the uppermost edges of the side panels are a pocket panel joined along a fold line to the uppermost edge of one of the side panels and folded on itself to define a downwardly opening pocket and a tuck flap panel is joined to the other side panel and folded upon itself to define a tuck flap to be inserted into the pocket. Abutment edge portions on the folded tuck flap confront intercept edge portions within the pocket when the tuck flap is fully inserted into the pocket to restrain the folded tuck flap against withdrawal from the pocket.

10 Claims, 2 Drawing Sheets

WRAPPER OR SLEEVE TYPE PACKAGE WITH POCKET AND FLAP LOCK

BACKGROUND AND OBJECTS OF THE INVENTION

The present invention relates in general to paperboard or cardboard packages having locking flaps associated therewith, and more particularly to sleeve or wrapper type packages of cardboard, paperboard or similar material, having a flap and a pocket for receiving the flap to hold the sleeve or wrapper type package in closed condition.

Heretofore, packages made of cardboard, paperboard or the like of the sleeve or wrapper type designed to extend around and form a retaining sleeve or wrap about an article or articles to be packaged have provided for locking opposite end portions of the blank together, but these have customarily employed a slit in one end portion of the paperboard blank and a tab formed in the opposite end portion of the paperboard blank to form a tab and slit arrangement for retaining the package in closed condition. Examples of such as tab and slit arrangement may be found in U.S. Pat. Nos. 4,732,316 to Oliff, 3,499,597 to Katzman which disclose a suspendable carton with a closure structure or display package comprising tabs which extend through or into slots to retain the closure structure or package in closed condition. With such a construction, the slit cut in the paperboard weakens the package, permitting it to tear readily in the zone in which the slit occurs, and this type of locking arrangement sometimes creates difficulties in properly engaging the tab in the slit in a consistent manner.

Glue panels have also been frequently resorted to in such sleeve or wrapper type packages, wherein flaps are folded into engagement with a mating or companion panel or flap having an adhesive surface or glue applied thereto to fasten the companion panels or flaps together. U.S. Pat. Nos. 3,312,337 to Martin and 4,549,654 to Tiesman are typical of this construction.

An object of the present invention is the provision of a sleeve or wrapper type package which is closed by a novel positive locking arrangement, wherein a folded flap is tucked into a pocket formed by a pocket panel, such that when the flap is inserted into the pocket, edges of the tuck flap automatically engage confronting edges of matching tabs inside the pocket to achieve locking of the flap within the pocket. This lock panel can be located in the center of the top surface of the package, thus providing a panel for a hang tab, a handle, graphics display, or other uses.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
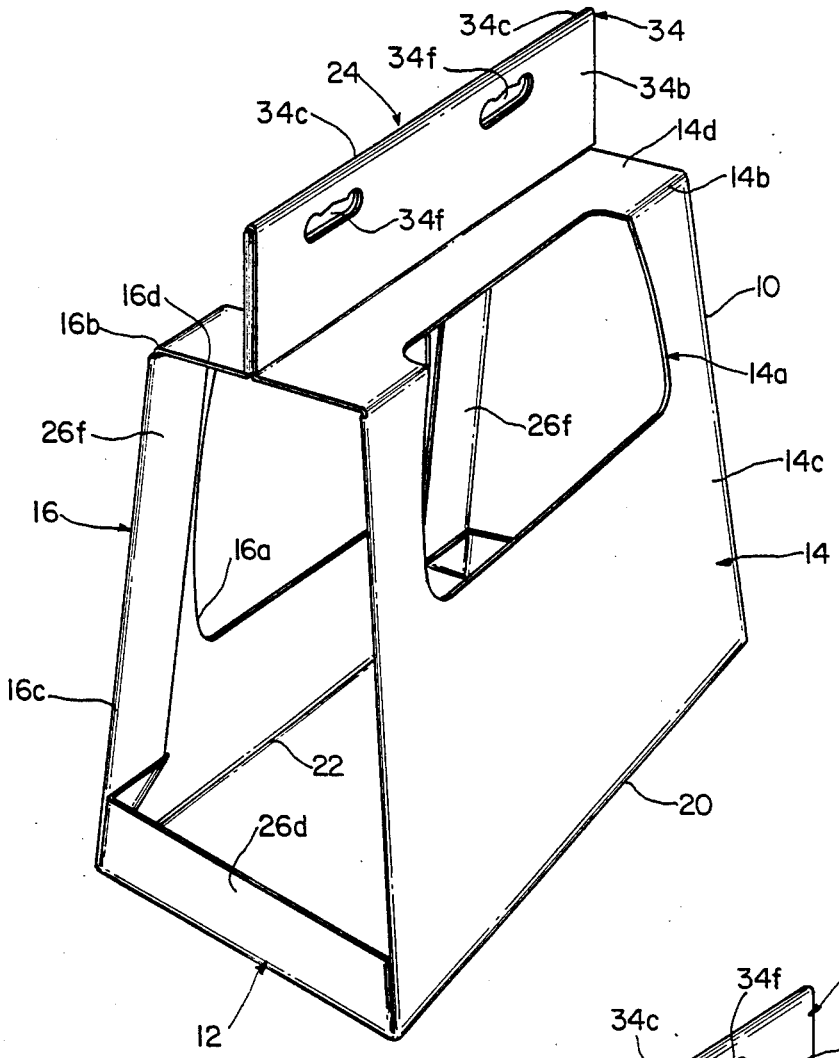
FIG. 1 is perspective view the sleeve or wrapper type package with the novel locking arrangement formed by a tuck flap and pocket panel in accordance with the present invention.

Referring to the drawings, wherein like reference characters designate corresponding parts throughout the several figures, the sleeve or wrapper type package embodying the present invention is indicated generally by the reference character 10, and in the illustrated embodiment is a sleeve type package designed to support a nutdriver set or similar article. The sleeve or wrapper type package 10 in the closed or erected position includes a bottom 12, upwardly convergent inclined side walls 14, 16 extending in upwardly converging relation from and joined to the lateral edges of the bottom 12 along fold or scored hinge lines 20 and 22 and having openings **14*a* and 16*a* therein. Score lines 14*b* and 16*b* are provided near but spaced somewhat below the upper edge of the side openings 14*a* and 16*a*, arranged in parallelism with the bottom fold lines or hinge lines 20, 22, and divide the panel into side portions 14*c*, 16*c* and portions 14*d*, 16*d*, which form top portion of the erected package to be locked together at their adjacent ends by the lock panel portion 24**.

Figure 4:
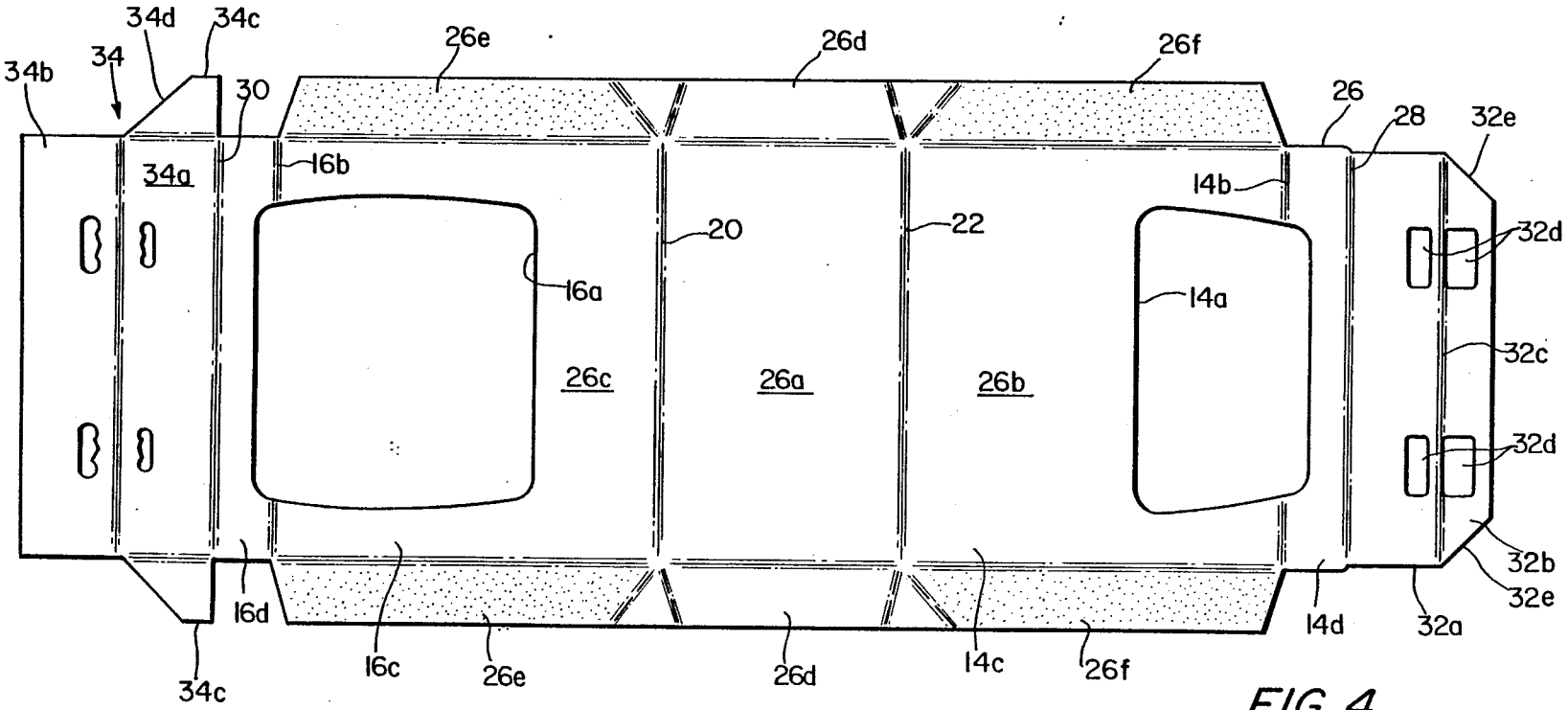
FIG. 4 is a plan view of the paperboard blank for the package of the present invention.

Referring particularly to the paperboard blank shown in FIG. 4, the blank 26 comprises a centrally located panel **26*a* forming the bottom 12 of the package, joined along the parallel transverse hinge lines or scores 20, 22 to panels 26*b* and 26*c* respectively forming the sides 14 and 16. As shown in FIG. 4, the panels 26*b* and 26*c* include the openings 14*a*, 16*a* cut therein and have scores 14*b* and 16*b* extending parallel to the hinge-forming score lines 20 and 22, spaced slightly toward the later from the uppermost edges of the openings 14*a*, 16*a*, and defining the lower boundary of the upper convergent panel portions 14*d* and 16*d*. The panels 26*b* and 26*c* are bounded at their edges opposite the hinge-forming score lines 20 and 22 by score lines 28 and 30. The lateral edges of the panels 26a, 26*b* and 26*c* have folded flap portions 26*d*, 26*e* and 26*f*, the tab portions 26*e* and 26*f* having adhesive thereon for securing the same in folded underlying relation against adjoining edge portions of the panels 26*b* and 26*c*, while the flap portions 26*b* are erected into perpendicular upstanding relation to the bottom panel 26*a* when the sides 14 and 16 are folded to the erected position of FIG. 1, providing a tray-like bottom 26*a*** bounded along all four edges by upwardly extending side wall portions.

Joined to the upper subpanel portion **14*d* of the side-forming panel 26*b* along the fold line 28 is the tuck flap panel formed of panel portions 32*a* and 32*b* joined together along an intermediate hinge-forming score line 32*c*. The portion 32*a* forms the base portion of the tuck flap panel and is rectangular in configuration, while the portion 32*b* forms the flap portion thereof and has inclined lateral edges as shown. Generally rectangular cut-outs 32*d* are provided in portions of the tuck flap base portions 32*a* and flap portion 32*b*** when the flap portion is folded into outwardly overlying relation, as shown in FIG. 2.

Figure 2:
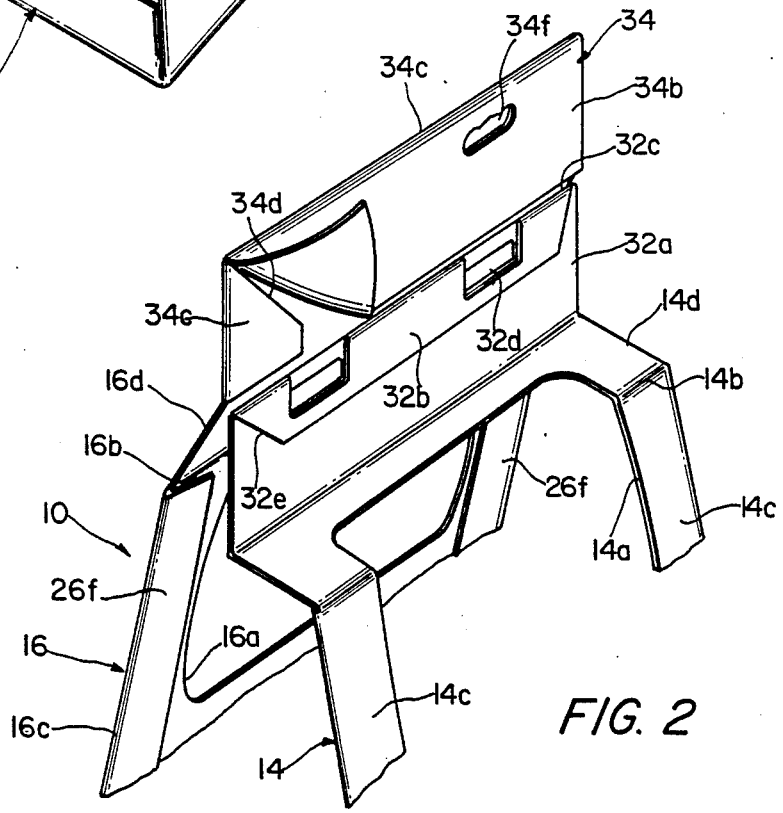
FIG. 2 is a fragmentary perspective view of upper parts of the package showing the foldable flap portion and pocket panel portion near each other in position to be inserted but prior to insertion of the tuck flap into the pocket formation, and showing part of the panel forming the pocket pulled away from its associated glue tab, to facilitate understanding of the construction of the package.
Figure 3:
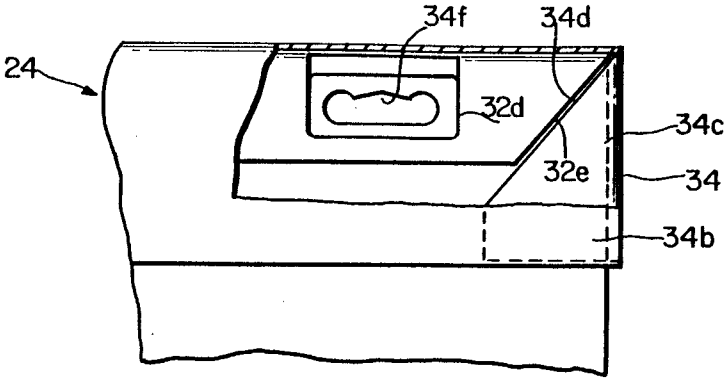
FIG. 3 is a fragmentary elevational view, with parts broken away, of the associated foldable tuck flap and pocket panel portions at an upper corner of the package.

The opposite or uppermost edge of the side-forming panel 26c defined by the fold line 30 joins the pocket panel, indicated at 34, to the side panel 26c, and comprises an inner rectangular pocket panel portion 34a and an outer rectangular pocket portion 34b to be folded along the fold lines 34c to overlie and register with the pocket panel portion 34a, as shown in FIGS. 1 and 2. The lateral edges of the innermost pocket panel portion 34a is provided with glue tabs 34c at the opposite sides thereof to be folded inwardly and glued to the confronting portions of the overlying pocket panel portion 34b, assuming the position as shown in FIG. 3. The glue tabs 34c are provided with inclined edges 34d which diverge upwardly toward the outermost corners of the pocket panel 34, and the outermost tuck flap 32b is provided with matching inclined edges 32e which engage and are effectively locked against and restrained in the pocket defined by the pocket panel, as the folded flap portion 32b following full insertion into the pocket tends to spring outwardly under elastic memory forces to be captured by the inclined edges 34d of the glue tabs 34c which are positioned to intercept outward withdrawal of the flaps edges 34e. Shaped openings 34f may be provided in the pocket panel portions 34a and 34b, which openings 34f register with the openings 32d in the tuck flap 32 to receive suitable hanger brackets or the like, such as pegboard display hangers, to removably support the package for display. The internested tuck flap and pocket formations also form a convenient handle for transporting the package, and provide a desirable surface for graphics display and the like.

I claim:

1. A wrapper type package of paperboard or the like for providing a laterally encompassing wrap package for articles, comprising an elongated blank of paperboard material or the like having a bottom panel, a pair of opposite side panels integrally joined to the bottom panel along a pair of parallel transverse fold lines to extend upwardly from the bottom panel in laterally encompassing relation to the article to be contained therein, the side panels being disposed immediately adjacent each other at their uppermost edges when in use position and having a pocket panel joined along a fold line to the uppermost edge of one of said side panels and folded along a zone thereof intermediate the juncture with said side panel and an opposite edge thereof to define a downwardly opening pocket formation between confronting portions of the pocket panel, and a tuck flap panel joined to the other of said side panels along the uppermost edge thereof along a transverse fold line and foldable upon itself to define a base flap subpanel and a folded flap subpanel collectively forming a tuck flap, the tuck flap being insertable into the pocket formation and having abutment edge portions at opposite end regions of said folded flap subpanel confronting an entrance portion of said pocket formation and said pocket panel including intercept edge portions paralleling and located immediately adjacent said abutment edge portions when said tuck flap is fully inserted in said pocket to lie in intercepting confrontational relation with said abutment edge portion restraining the folded flap subpanel against withdrawal from said pocket formation.

2. A package as defined in claim 1, wherein said bottom panel and side panels are of generally rectangular configuration.

3. A package as defined in claim 1, wherein said abutment edge portions and said intercept edge portions are straight edges disposed parallel to each other in downwardly and inwardly inclined planes converging toward a longitudinal center line of said panel.

4. A package as defined in claim 2, wherein said abutment edge portions and said intercept edge portions are straight edges disposed parallel to each other in downwardly and inwardly convergent planes converging toward a longitudinal center line of said panel.

5. A package as defined in claim 1, wherein the foldable subpanel portions of said pocket panel are of substantially rectangular configuration and in substantially overlying registry with each other.

6. A package as defined in claim 1, wherein the foldable subpanel portions of said pocket panel are of substantially rectangular configuration and in substantially overlying registry with each other and have long sides extending transversely across the blank in parallelism with the fold lines joining the side panels with the bottom panel.

7. A package as defined in claim 2, wherein the foldable subpanel portions of said pocket panel are of substantially rectangular configuration and in substantially overlying registry with each other.

8. A package as defined in claim 2, wherein the foldable subpanel portions of said pocket panel are of substantially rectangular configuration and in substantially overlying registry with each other and have long sides extending transversely across the blank in parallelism with the fold lines joining the side panels with the bottom panel.

9. A package as defined in claim 4 wherein the foldable subpanel portions of said pocket panel are of substantially rectangular configuration and in substantially overlying registry with each other.

10. A package as defined in claim 4, wherein the foldable subpanel portions of said pocket panel are of substantially rectangular configuration and in substantially overlying registry with each other and have long sides extending transversely across the blank in parallelism with the fold lines joining the side panels with the bottom panel.

* * * * *